US010059129B2

(12) United States Patent
Sato

(10) Patent No.: US 10,059,129 B2
(45) Date of Patent: Aug. 28, 2018

(54) PRINTING APPARATUS AND METHOD FOR REMOVING CONTAMINANTS IN PRINTING APPARATUS

(71) Applicant: Seiko Epson Corporation, Tokyo (JP)

(72) Inventor: Takumi Sato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 25 days.

(21) Appl. No.: 15/373,952

(22) Filed: Dec. 9, 2016

(65) Prior Publication Data

US 2017/0165984 A1 Jun. 15, 2017

(30) Foreign Application Priority Data

Dec. 14, 2015 (JP) ..... 2015-242930

(51) Int. Cl.

| | |
|---|---|
| ***B41J 2/01*** | (2006.01) |
| ***B41J 11/66*** | (2006.01) |
| ***B26D 1/01*** | (2006.01) |
| ***B41J 11/70*** | (2006.01) |

(52) U.S. Cl.

CPC ..... *B41J 11/663* (2013.01); *B26D 1/015* (2013.01); *B41J 2/01* (2013.01); *B41J 11/706* (2013.01)

(58) Field of Classification Search

CPC ..... B41J 2/01; B41J 11/663; B41J 11/706; A01B 12/006; B26D 1/015

See application file for complete search history.

(56) References Cited

U.S. PATENT DOCUMENTS 7,815,382 B2 * 10/2010 Monclus ..... B26D 1/0006 400/621

FOREIGN PATENT DOCUMENTS

| | | |
|---|---|---|
| JP | 2003-312882 A | 11/2003 |
| JP | 2010-179467 A | 8/2010 |

* cited by examiner

*Primary Examiner* — Lamson Nguyen
(74) *Attorney, Agent, or Firm* — Workman Nydegger

(57) ABSTRACT

A printing apparatus includes a printing portion that performs printing on a medium, a cutting portion that is capable of moving in a movement direction and that has cutting blades that cut the medium and a housing unit that holds the cutting blades, and a contact portion provided at a position at which the contact portion comes into contact with the housing unit when the cutting portion moves in the movement direction.

9 Claims, 6 Drawing Sheets

PRINTING APPARATUS AND METHOD FOR REMOVING CONTAMINANTS IN PRINTING APPARATUS

BACKGROUND

1. Technical Field

The present invention relates to a printing apparatus and a method for removing contaminants in the printing apparatus.

2. Related Art

Conventionally, an image forming device provided with a transcript material cutting apparatus including a movable rotating blade and a cleaning member for wiping off ink attached to the movable rotating blade is known (for example, JP-A-2010-179467).

For example, when cutting paper with the above-mentioned transcript material cutting apparatus, contaminants such as paper powder or the like formed during cutting of the paper may become attached to a housing unit that holds the movable rotating blade. However, in the above-mentioned image forming device there is a problem in that, because it does not have a function of cleaning a housing unit, contaminants which become attached to the housing unit at the time of the movement of the transcript material cutting apparatus become scattered and the scattered contaminants attach to a recording head which results in the occurrence of poor printing.

SUMMARY

The invention is capable of being realized as the following aspects and application examples.

Application Example 1

A printing apparatus of this application example includes a printing portion that performs printing on a medium, a cutting portion that is capable of moving in a movement direction and that has cutting blades that cut the medium and a housing unit that holds the cutting blades, and a contact portion provided at a position at which the contact portion comes into contact with the housing unit when the cutting portion moves in the movement direction.

According to this configuration, in the case where contaminants formed during cutting of the roll paper by the cutting portion attach to the housing unit, the contaminants attached to the housing unit are removed by making a housing unit come into contact with the contact portion. Therefore, it is possible to suppress attachment of contaminants to the print portion due to scattering of the contaminants and it is possible to decrease the occurrence of poor printing.

Application Example 2

The printing apparatus of the above application example is provided in which the contact portion is arranged at a position at which the contact portion does not contact the cutting blades when the cutting portion moves in the movement direction.

According to this configuration, it is possible to suppress damage to the contact portion caused by cutting of the cutting blades because the contact portion and the cutting blades do not come into contact with each other.

Application Example 3

The printing apparatus of the above application example is provided in which the cutting portion is capable of moving to a waiting position which is a position at which it waits while cutting of the medium is not performed and to a cutting start position which is a position at which cutting of the medium starts, and the contact portion is provided between the waiting position and the cutting start position.

According to this configuration, the contact portion and the cutting portion come into contact with each other when the cutting portion moves between the waiting position and the cutting start position and do not come into contact with each other when the cutting portion is at the waiting position. Consequently, it is possible to reduce the likelihood of the shape of the contact portion being changed by the cutting portion.

Application Example 4

The printing apparatus of the above application example is provided in which the contact portion has a plurality of elastic members arranged in a line in a direction that intersects the movement direction, and the elastic members come into contact with the housing unit when the cutting portion moves in the movement direction.

According to this configuration, because the plurality of elastic members deform in accordance with the shape of the housing unit, it is possible to suitably remove contaminants attached to the housing unit.

Application Example 5

The printing apparatus of the above application example is provided in which the contact portion is formed of a conductive member.

According to this configuration, because the housing unit can be destaticized when the contact portion comes into contact with the housing unit, it is possible to suppress the housing unit from becoming charged and contaminants from easily attaching to the housing unit. Moreover, it is possible to suppress contaminants from attaching, by static electricity, to the contact portion itself.

Application Example 6

The printing apparatus of the above application example is provided further including a storage unit that stores contaminants removed from the housing unit by the contact portion.

According to this configuration, it is possible to suitably store contaminants that have been removed from the housing unit by the contact portion. Consequently, the operation of disposing contaminants becomes easy.

Application Example 7

A method of removing contaminants in a printing apparatus of this application example including a print portion that performs printing on a medium, a cutting portion that is capable of moving in a movement direction and that has cutting blades that cut the medium and a housing unit that holds the cutting blades, and a contact portion provided along a movement path of the cutting portion, includes moving the cutting portion in the movement direction, and making the housing unit and the contact portion come into contact with each other.

According to this configuration, in the case where contaminants formed during cutting of the roll paper P by the cutting portion attach to the housing unit, the contaminants attached to the housing unit are removed by making the housing unit coming into contact with the contact portion. Therefore, it is possible to suppress attachment of contaminants to the print portion due to scattering of the contaminants and it is possible to decrease the occurrence of poor printing.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the accompanying drawings. Further, in each of the following diagrams, in order to make each member and the like be recognizable, the scale of each member and the like differs from actuality.

First, the structure of the printing apparatus will be described. The printing apparatus is, for example, an ink jet printing apparatus that ejects ink from a printing unit to a medium such as recording paper to perform printing (recording) on the medium.

Figure 1:
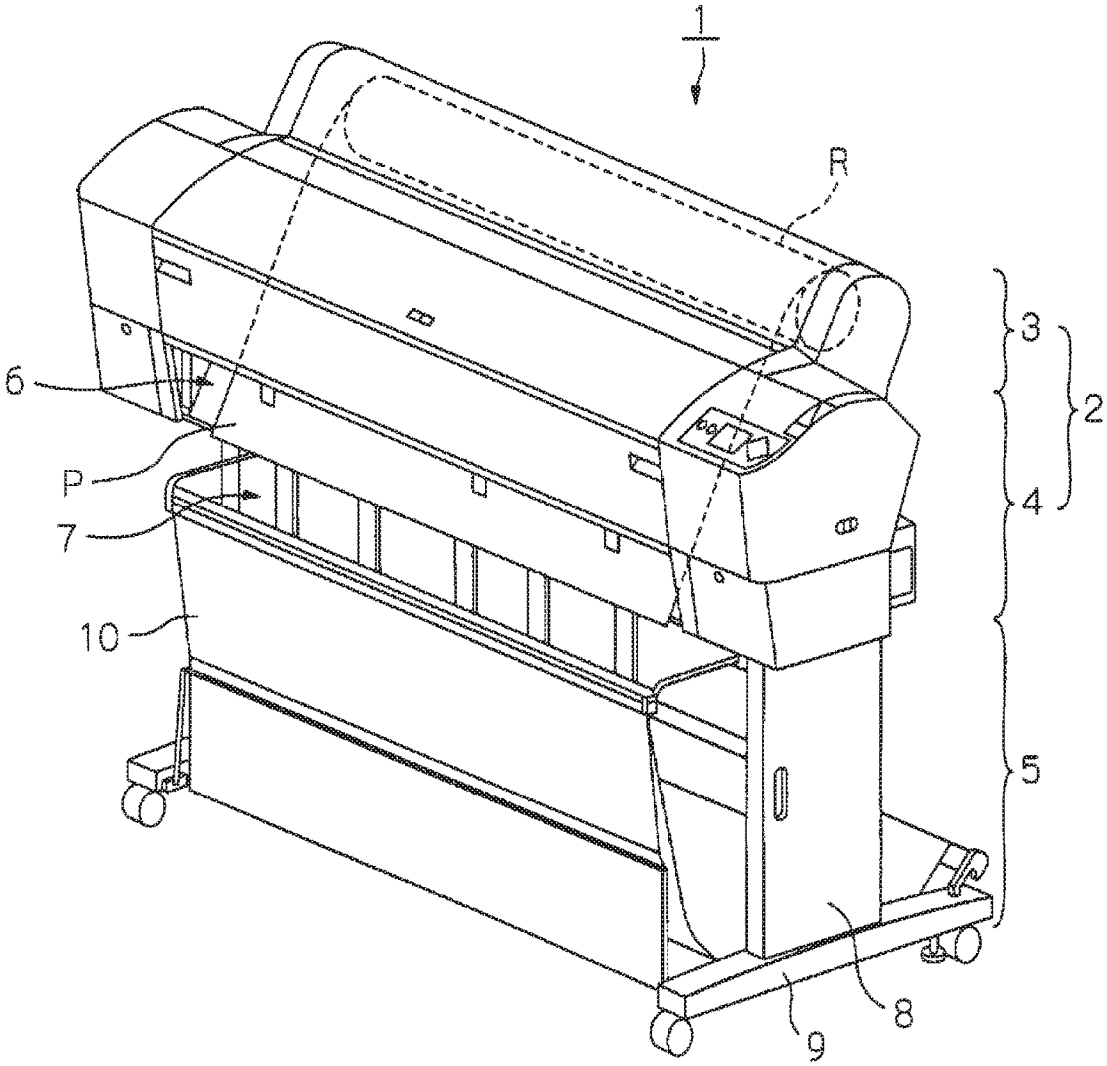
FIG. 1 is a schematic perspective diagram illustrating a structure of a printing apparatus.
Figure 2:
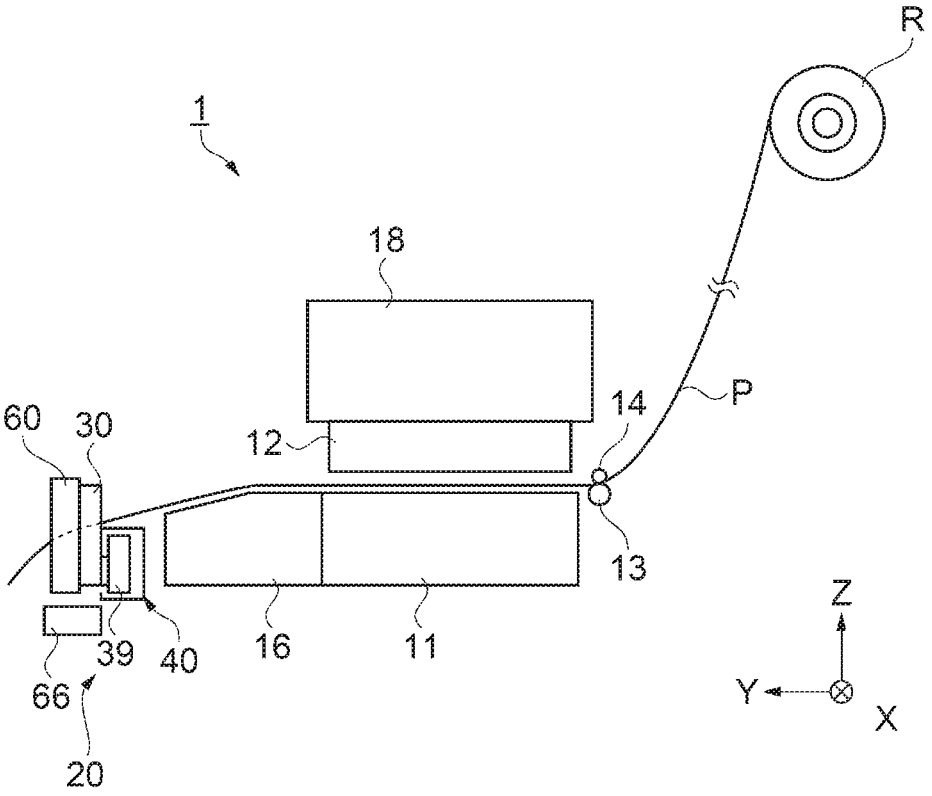
FIG. 2 is a schematic side view of a structure of one portion of the printing apparatus.
Figure 3:
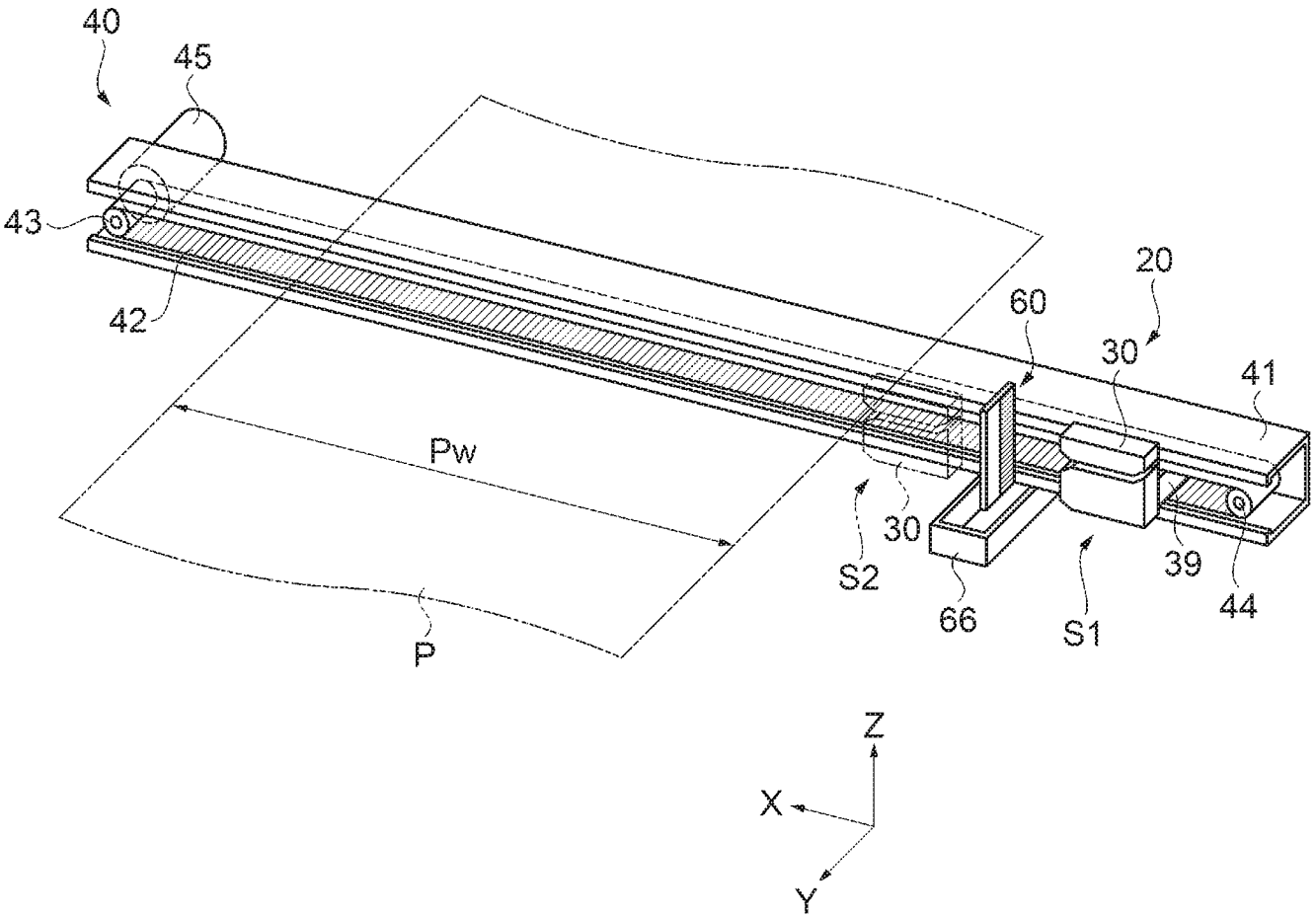
FIG. 3 is a schematic diagram illustrating a structure around a cutting unit.
Figure 4:
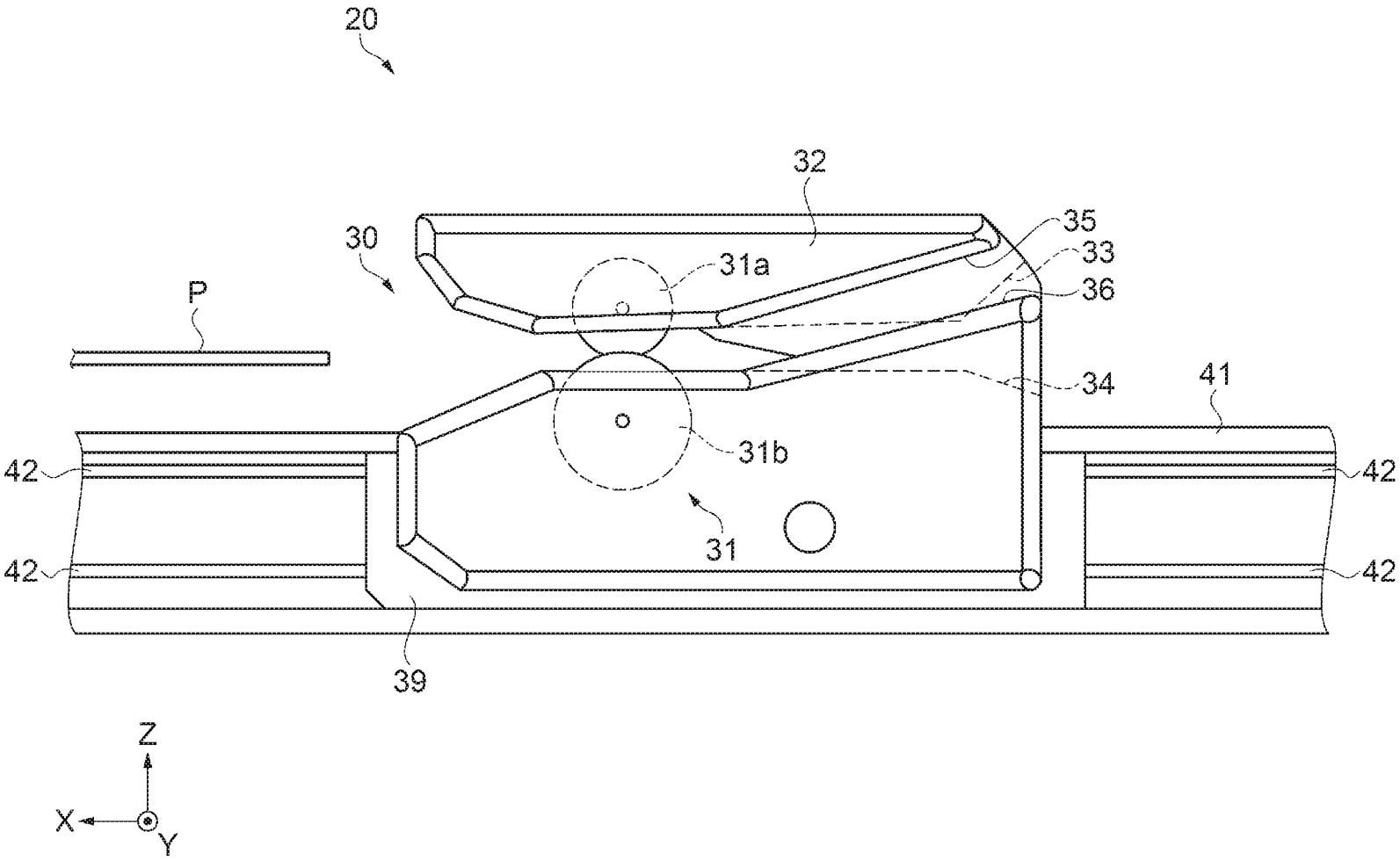
FIG. 4 is a schematic diagram illustrating a structure of the cutting unit.
Figure 5:
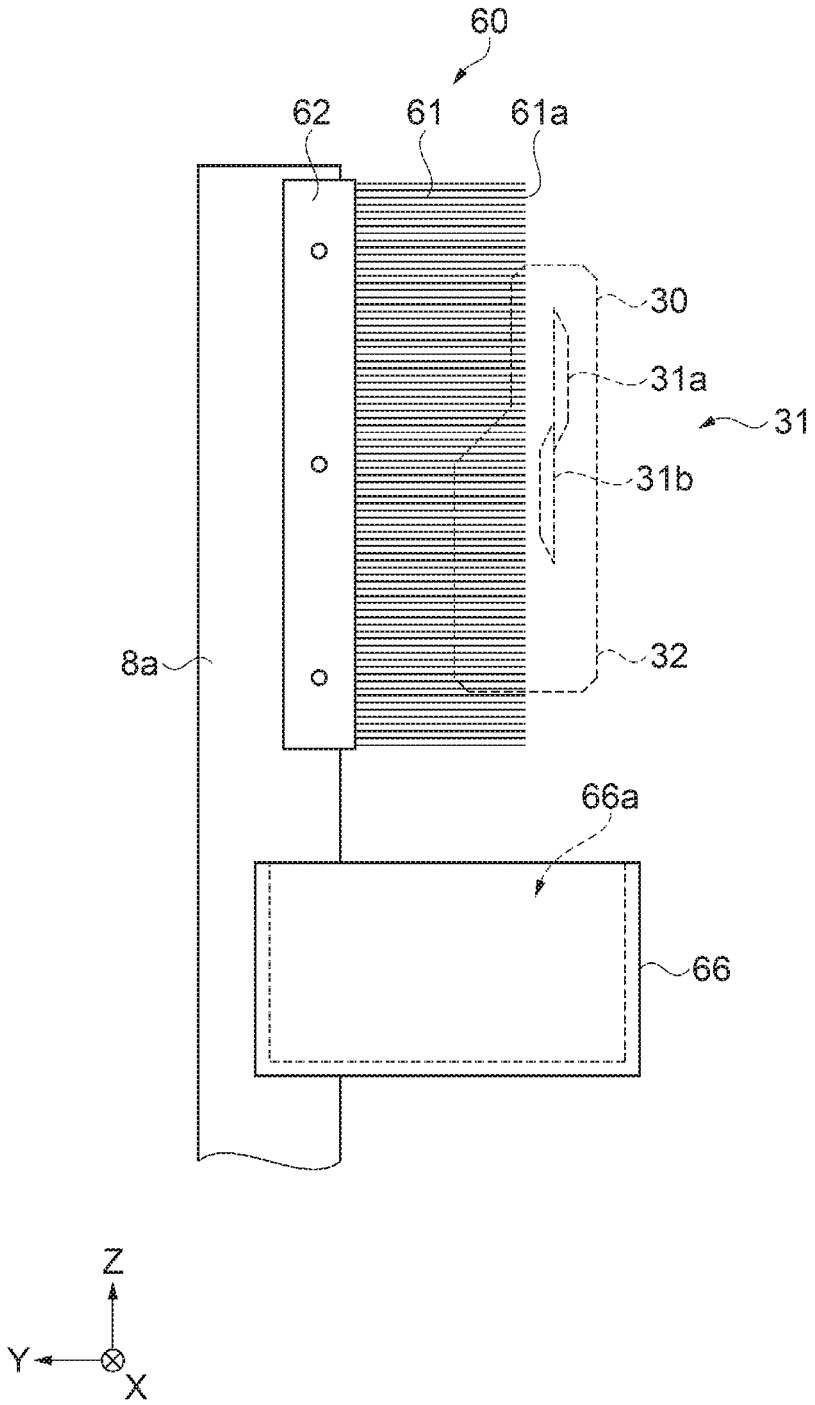
FIG. 5 is a schematic diagram illustrating a structure of a contact unit.

FIG. 1 is a schematic perspective diagram illustrating a structure of a printing apparatus and FIG. 2 is a schematic side view of a structure of one portion of the printing apparatus. Moreover, FIG. 3 is a schematic diagram illustrating a structure around a cutting unit, FIG. 4 is a schematic diagram illustrating a structure of the cutting unit, and FIG. 5 is a schematic diagram illustrating a structure of a contact unit.

As illustrated in FIGS. 1 and 2, a printing apparatus 1 is, for example, a large-scale printer capable of printing on a medium (roll paper P) having a width Pw (refer to FIG. 3) which is of a relatively large size such as the A0 size or B0 size of the JIS specification, and includes a main body portion 2, which includes a roll paper supply portion 3 and a printing main body portion 4, and a paper ejecting portion 5. The main body portion 2 is provided on an upper portion of a support 8 erected on a base 9, and includes an ejection port 6 that ejects roll paper P, on which printing (recording) has been performed, diagonally downward. An opening 7 of a stacker 10 is located below the ejection port 6 and roll paper P on which recording has been performed is ejected from the ejection port 6 to the opening 7 and is received by the stacker 10.

A roll R that the roll paper P is wound off (hereinafter called "roll") is formed so as to be storable in the roll paper supply portion 3, the roll paper P is reeled out from the roll R and is supplied diagonally downward to the printing main body portion 4 that performs printing. The roll R is set in a roll paper holder (not illustrated). When supplying roll paper, the roll paper P is supplied downstream in the transport direction (Y-axis direction) by the roll paper holder being rotationally driven by a spindle motor (not illustrated) as a roll driving device.

The printing main body portion 4 has a head 12 that discharges (ejects) ink as a liquid toward the roll paper P, a platen 11 arranged opposite the head 12, a transport driving roller 13 (transport roller) that transports the roll paper P in a transport direction (Y-axis direction) and that is provided upstream of the head 12 in the transport direction, and a transport driven roller 14 that drivenly rotates as a result of being pushed against the transport driving roller 13. An image is printed on the roll paper P by ink being discharged from the head 12 onto the roll paper P as a medium. In other words, the head 12 is a printing unit that performs printing on a medium.

The head 12 is provided on a carriage 18, and the carriage 18, while being guided by a guide shaft (not illustrated) that extends in the scanning direction of the head 12 (main scanning direction, X-axis direction) and by a guide plate (not illustrated) that also extends in the main scanning direction (X-axis direction), is driven by a motor (not illustrated) and moves in the main scanning direction. On the downstream side of the head 12 in the transport direction, an air suction unit 16 serving as a paper suction unit is provided and the roll paper P is prevented from rising toward the downstream side of the head 12 in the transport direction by the air suction unit 16, and a decrease in printing quality due to rising of the roll paper P is prevented.

A cutting portion 20 that cuts the roll paper P is provided on the downstream side of the air suction unit 16 in the transport direction.

The cutting portion 20 includes a cutter unit 30 and a cutter carriage 39 on which the cutter unit 30 is mounted. In addition, a drive mechanism 40 that causes the cutting portion 20 to move to and fro in the X-axis direction is included.

The drive mechanism 40, as illustrated in FIG. 3, includes a guiderail 41 that extends in the X-axis direction, a timing belt 42 that is arranged along the direction in which the guiderail 41 extends and on which a plurality of teeth are formed on the inside, a drive pulley 43 and a driven pulley 44 that engage with the teeth of the timing belt 42, a motor 45 that drives the drive pulley 43, and the like. The timing belt 42 rotates with the rotation of the drive pulley 43 by the driving of the motor 45.

The cutter carriage 39 is fixed on a portion of the timing belt 42 and it is possible to move the cutter carriage 39 along the guiderail 41 by driving of the timing belt 42. Consequently, the cutter unit 30 mounted on the cutter carriage 39 is movable in the X-axis direction (movement direction).

Hereafter, the structure of the cutter unit will be described. As illustrated in FIG. 4, the cutter unit 30 includes cutting blades 31 that cut the roll paper P and a housing unit 32 that holds the cutting blades 31. Moreover, the cutting blades 31 include a first blade 31*a* and a second blade 31*b*. The first blade 31*a* and the second blade 31*b* are formed so as to operate together and cut the roll paper P. Specifically, the first blade 31*a* is provided on the side of the recording surface of the roll paper P (main surface) and on the upstream side of the second blade 31*b* in the transport direction. In contrast, the second blade 31*b* is provided on the side of the surface opposite to the recording surface of the roll paper P and on the downstream side of the first blade 31*a* in the transport direction.

Moreover, a groove is provided on the upstream side of the cutter unit 30 of the housing unit 32 in the transport direction, and the groove has a first slope 33 and a second slope 34 that guide an upstream portion of the roll paper P, which has been sheared, in the transport direction. Moreover, a groove is also provided on the downstream side of the cutter unit 30 of the housing unit 32 in the transport direction, and the groove has a third slope 35 and a fourth slope 36 that guide a downstream portion of the roll paper P, which has been sheared, in the transport direction. It is possible to easily guide the roll paper P by the groove formed by the first slope 33 and the second slope 34 provided on the upstream side in the transport direction and the groove formed by the third slope 35 and the fourth slope 36 provided on the downstream side in the transport direction.

Moreover, in this embodiment, the second blade 31*b* is formed so as to drivingly rotate while moving in the X-axis direction and the first blade 31*a* is formed so as to drivenly rotate by pressure of the roll paper P while moving in the X-axis direction. Moreover, the second blade 31*b* rotates in the direction of rolling (counterclockwise direction in FIG. 4) of the roll paper P. Therefore, the roll paper P can be sheared more reliably.

There is a case where paper powder formed during cutting of the roll paper P by the cutter unit 30 of the cutting portion 20 attaches to the surface of the housing unit 32. Specifically, it is known that a lot of paper powder or the like attaches to the groove in the third slope 35 and the fourth slope 36 and that there is therefore a tendency for this paper powder to easily accumulate. Further, when the cutter unit 30 moves to and fro in the X-axis direction and when paper powder is attached to (accumulates on) the housing unit 32, there is a risk of the paper powder attached to the housing unit 32 scattering and attaching to the head 12, which results in poor printing, and the paper powder or the like attached to the housing unit 32 scattering and attaching to the region of the roll paper P on which printing has been performed which results in a decrease in image quality. Therefore, a contact portion 60 that removes paper powder attached to the housing unit 32 is provided in the printing apparatus 1 of this embodiment.

The contact portion 60 is arranged so as to be in contact with the housing unit 32. Specifically, the contact portion 60 is arranged at a position so as to come into contact with the housing unit 32 when the cutter unit 30 of the cutting portion 20 moves in the movement direction (X-axis direction). That is, the contact portion 60 is arranged on the movement path of the cutting portion 20. Further, the contact portion 60 of this embodiment is arranged on the downstream side of the cutting portion 20 in the transport direction (refer to FIG. 2).

As illustrated in FIG. 5, the contact portion 60 of this embodiment is an anti-static brush and includes fibers 61 that serve as a plurality of elastic members in a line in a direction (Z-axis direction) perpendicular to the movement direction (X-axis direction) of the cutter unit 30, and the fibers 61 are formed so as to come into contact with the housing unit 32 when the cutter unit 30 of the cutting portion 20 moves in the movement direction (X-axis direction). Further, the plurality of the fibers 61 are held by a holding unit 62. Moreover, the holding unit 62 is fixed on an end portion 8*a* that is in connected to the support 8.

Moreover, the contact portion 60 is formed of a conductive member. Specifically, the fibers 61 are formed of conductive fibers and the holding unit 62 is also formed of a conductive member. Furthermore, the end portion 8*a* of the support 8 is a conductive member and the support 8 is ground.

The contact portion 60 is arranged at a position so as not to contact the cutting blades 31 when the cutting portion 20 moves in the movement direction (X-axis direction). Specifically, as illustrated in FIG. 5, when viewing the contact portion 60 in the X-axis direction, the length of the fibers 61 is set so that tips 61*a* of the fibers 61 of the contact portion 60 do not reach the cutting blades 31. Moreover, the length of the fibers 61 is set to such a degree as to come into contact with the groove having the third slope 35 and the fourth slope 36. Consequently, other than the surface of the housing unit 32, the fibers 61 can come into contact with irregular portions of the groove or the like.

Moreover, a storage unit 66 is included that stores contaminants removed from the housing unit 32 by the contact portion 60. The storage unit 66 of this embodiment is a box-shaped container that includes an opening 66*a*. The storage unit 66 is arranged above the opening 66*a* on the downstream side of the contact portion 60. Consequently, when the contact portion 60 comes into contact with the housing unit 32, paper powder or the like that has fallen in the direction of gravity (Z-axis direction) is stored by the storage unit 66.

Hereafter, the position at which the contact portion 60 is arranged will be described. As illustrated in FIG. 3, the cutting portion 20 (the cutter unit 30) is capable of moving to a waiting position S1 which is a position at which waiting is performed when not cutting the roll paper P and to a cutting start position S2 which is a position at which cutting of the roll paper P is started, and is arranged between the waiting position S1 and the cutting start position S2. That is, the contact portion 60 is arranged further toward the plus X-axis direction side than the cutter unit 30 arranged at the waiting position S1.

Hereafter, the method of removing contaminants in the printing apparatus will be described. Further, the method of removing contaminants in the printing apparatus 1 will be described. Because the structure of the printing apparatus 1 is the same as that described above, description thereof is omitted. The method of removing contaminants in the printing apparatus 1 is a method that involves moving the cutting portion 20 in the movement direction (X-axis direction), making the housing unit 32 and the contact portion 60 come into contact with each other, and removing contaminants such as paper powder attached to the surface of the housing unit 32.

Figure 6:
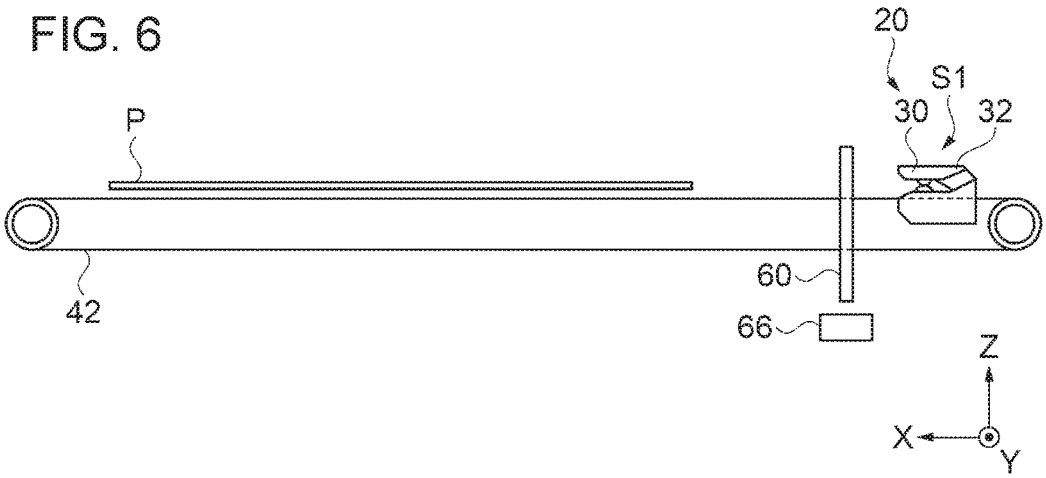
FIG. 6 is an explanatory diagram illustrating a method for removing contaminants in the printing apparatus.
Figure 7:
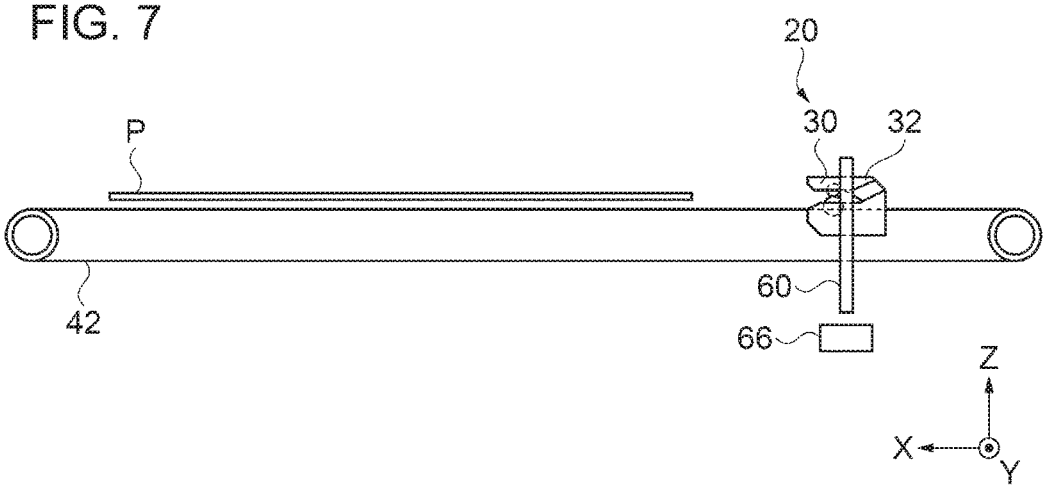
FIG. 7 is an explanatory diagram illustrating a method for removing contaminants in the printing apparatus.
Figure 8:
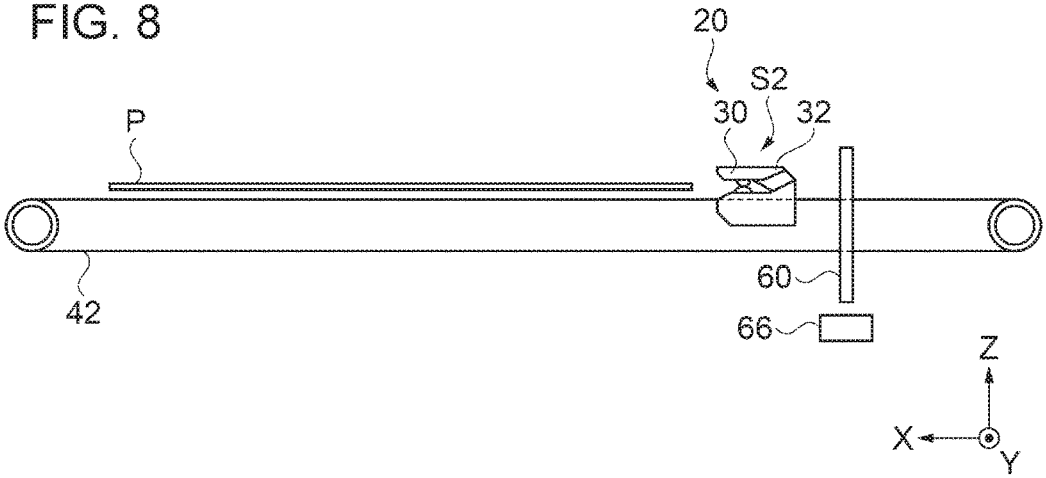
FIG. 8 is an explanatory diagram illustrating a method for removing contaminants in the printing apparatus.

FIGS. 6 to 8 are explanatory diagrams illustrating the method of removing contaminants in the printing apparatus. Further, the guiderail and the like are not illustrated.

FIG. 6 illustrates a state in which the cutter unit 30 is located at the waiting position S1. This state is a waiting state in which the cutter unit 30 does not cut the roll paper P. In this state, the contact portion 60 is positioned in the plus X-axis direction with respect to the cutter unit 30 and is not in contact with the cutter unit 30. Therefore, it is possible to reduce the likelihood of the shape of the contact portion 60 being changed by the cutter unit 30 waiting at the waiting position S1.

FIG. 7 illustrates a state in which the cutter unit 30 is made to move from the waiting position S1 toward the cutting start position S2 and the contact portion 60 is in contact with the housing unit 32 of the cutter unit 30 (a state in which the cutter unit 30 is positioned at a contact position at which it is in contact with the contact portion 60). In this state, the fibers 61 of the contact portion 60 contact the surface of the housing unit 32 due to the movement of the cutter unit 30 and remove contaminants such as paper powder attached to the housing unit 32.

Because the contact portion 60 has a plurality of the fibers 61 (elastic members), it is possible for the contact portion 60 to contact the housing unit 32 so as to follow the shape of the surface of the housing unit 32 and it is possible to reliably remove contaminants such as paper powder attached to the housing unit 32.

Further, because the fibers 61 do not contact the cutting blades 31, it is possible to prevent damage to the cutting blades 31. Moreover, because the fibers 61 are also not cut by the cutting blades 31, scattering of pieces of fiber can be prevented.

Furthermore, because the contact portion 60 is formed of a conductive member and is ground, the surface of the housing unit 32 is destaticized through contact of the contact portion 60 and the housing unit 32.

Moreover, because the contact portion 60 itself is destaticized, it is possible to prevent attachment of paper powder or the like to the contact portion 60 itself.

Contaminants such as paper powder removed from the housing unit 32 by the contact portion 60 fall in the direction of gravity (Z-axis direction) and are captured by the storage unit 66 that is provided below the contact portion 60. Consequently, it is possible to prevent scattering of paper powder or the like removed from the housing unit 32. Further, contaminants such as paper powder or the like stored in the storage unit 66 are suitably discarded.

FIG. 8, furthermore, illustrates a state in which the cutter unit 30 is moved in the plus X-axis direction up to the cutting start position S2. In this state, the cutter unit 30 is in a state of starting to cut the roll paper P. In this state, the cutter unit 30 is in a state in which there are no contaminants such as paper powder on the surface of the housing unit 32 because it has passed the contact portion 60. Furthermore, the cutter unit 30 is moved in the plus X-axis direction and when the roll paper P is cut, paper powder or the like attached to the housing unit 32 does not scatter.

Further, the cutter unit 30 is moved in the plus X-axis direction, and after the roll paper P has been cut, the cutter unit 30 is moved in the minus X-axis direction (the waiting position S1 direction). At this time, just before the cutter unit 30 arrives at the waiting position S1, the housing unit 32 of the cutter unit 30 contacts the contact portion 60 again. Contaminants such as paper powder or the like attached to the housing unit 32 are removed by the contact portion 60 (refer to FIG. 7). Afterwards, the cutter unit 30 moves up to the waiting position S1 and enters a waiting state. Thereafter, the operation described above is repeated.

According to the above-described embodiment, it is possible to obtain the effect described below.

In the case where contaminants such as paper powder or the like formed during cutting of the roll paper P by the cutter unit 30 of the cutting portion 20 attach to the housing unit 32, the contaminants attached to the housing unit 32 are removed by making the housing unit 32 come into contact with the contact portion 60. Therefore, it is possible to suppress attachment of contaminants such as paper powder or the like to the head 12 or the like and it is possible to decrease the occurrence of poor printing.

The invention is not limited to the above-described embodiment, and various modifications, improvements or the like can be made to the above embodiment. Modification examples are described below.

Modification Example 1

In the above-described embodiment, the cutting portion 20 is arranged on one surface side of the housing unit (downstream side of the cutting portion 20 in the transport direction); however, the structure is not limited to this. The contact portion 60 may be provided on the other surface side of the housing unit 32 (upstream side of the cutting portion 20 in the transport direction) or may be provided on both surface sides of the housing unit 32. That is, it is preferable to arrange the contact portion 60 taking into consideration the position at which the contaminants such as paper powder or the like attach to the housing unit 32. By doing this, it is possible to efficiently remove contaminants such as paper powder or the like attached to the housing unit 32.

Modification Example 2

The form of the contact portion 60 of the above-described embodiment is that of an anti-static brush; however, the structure is not limited to this. For example, the form of the contact portion 60 may be, other than an anti-static brush, a resin member such as a sponge or the like, or a fabric member or the like. In this way, it is possible to realize the same effect as above. Further, in the case where a resin member, cloth member, or the like serving as the contact portion 60 is used, it is preferable to divide the member into a plurality of members and arrange the members in a line in a direction (Z-axis direction) that intersects the movement direction (X-axis direction) of the cutter unit 30. Consequently, it is possible for the resin member, cloth member, or the like to contact the housing unit 32 so as to follow the shape of the surface of the housing unit 32 and it is possible to remove contaminants such as paper powder attached to the housing unit 32.

Modification Example 3

The lengths of the fibers 61 of the contact portion 60 of the above-described embodiment are set so as to be uniform; however, the structure is not limited to this. The length of the fibers 61 may be suitably changed in accordance with the shape of the surface of the housing unit 32 or the like. Moreover, the fibers 61 may be arranged so as to have different elasticity in accordance with the shape of the housing unit 32. By doing this, furthermore, it is possible to efficiently remove contaminants such as paper powder or the like attached to the housing unit 32. Moreover, it is possible to decrease the contact load on the housing unit 32 by the contact portion 60.

Modification Example 4

In the above-described embodiment, the contact portion 60 is provided between the waiting position S1 of the cutter unit 30 and the cutting start position S2 of the cutter unit 30; however, the structure is not limited to this. For example, the contact portion 60 may be arranged at a position at which cutting of the roll paper P is completed after the cutter unit 30 has moved in the plus X-axis direction. By doing this, it is possible to remove contaminants such as paper powder or the like by the housing unit 32 coming into contact with the contact portion 60. Furthermore, the contact portion 60 may be arranged at a position between the waiting position S1 and the cutting start position S2 at which cutting of the roll paper P is completed. By doing this, it is possible to reliably remove contaminants such as paper powder or the like attached to the housing unit 32.

Modification Example 5

The contact portion 60 of the above-described embodiment may have a vibration generating portion. By doing this, for example, it is possible to remove, by vibration, contaminants such as paper powder or the like entangled in the fibers 61.

Modification Example 6

In the above-described embodiment, even though the contact portion 60 and the housing unit 32 of the cutter unit 30 are made to come into contact with each other by making the cutter unit 30 move with respect to the contact portion 60, the structure is not limited to this. For example, the contact portion 60 and the housing unit 32 of the cutter unit 30 may be made to come into contact with each other by making the contact portion 60 move with respect to the cutter unit 30. By doing this, that is, by making the contact portion 60 and the housing unit 32 come into contact with each other, it is possible to remove contaminants such as paper powder or the like.

Modification Example 7

In the above-described embodiment, the storage unit 66 serves as a container; however, the structure is not limited to this. For example, the structure is not limited as long as a region for storing paper powder or the like that has been removed is secured, that is, as long as a region that is partitioned from other regions is provided in order to suppress scattering of paper powder or the like. In this way, it is possible to realize the same effect as above.

This application claims priority under 35 U.S.C. § 119 to Japanese Patent Application No. 2015-242930, filed Dec. 14, 2015. The entire disclosure of Japanese Patent Application No. 2015-242930 is hereby incorporated herein by reference.

What is claimed is:

1. A printing apparatus comprising:

a printing portion that performs printing on a medium, a cutting portion that is capable of moving in a movement direction and that has a cutting blade that cuts the medium and a housing unit that holds the cutting blade, wherein the cutting portion is capable of moving to a waiting position at which the cutting blade does not contact the medium, and to a cutting start position, at which the cutting blade moved from the waiting position toward the medium contacts with the medium, a contact portion provided at a position at which the contact portion comes into contact with the housing unit when the cutting portion moves in the movement direction, the contact portion being provided between the waiting position and the cutting start position.

2. The printing apparatus according to claim 1, wherein the contact portion is provided at a position at which the contact portion does not contact the cutting blades when the cutting portion moves in the movement direction.

3. The printing apparatus according to claim 2, wherein the contact portion has a plurality of elastic members arranged in a line in a direction that intersects the movement direction, and the elastic members come into contact with the housing unit when the cutting portion moves in the movement direction.

4. The printing apparatus according to claim 2, wherein the contact portion is formed of a conductive member.

5. A printing apparatus comprising:

a printing portion that performs printing on a medium, a cutting portion that is capable of moving in a movement direction and that has a cutting blade that cuts the medium and a housing unit that holds the cutting blade, a contact portion provided at a position at which the contact portion comes into contact with the housing unit when the cutting portion moves in the movement direction; and a storage unit that stores contaminants removed from the housing unit by the contact portion.

6. The printing apparatus according to claim 5, wherein the contact portion is provided at a position at which the contact portion does not contact the cutting blades when the cutting portion moves in the movement direction.

7. The printing apparatus according to claim 6, wherein the contact portion has a plurality of elastic members arranged in a line in a direction that intersects the movement direction, and the elastic members come into contact with the housing unit when the cutting portion moves in the movement direction.

8. The printing apparatus according to claim 6, wherein the contact portion is formed of a conductive member.

9. A method of removing contaminants in a printing apparatus including a print portion that performs printing on a medium, a cutting portion that is capable of moving in a movement direction and that has a cutting blade that cuts the medium and a housing unit that holds the cutting blades, and a contact portion provided along a movement path of the cutting portion, comprising:

moving the cutting portion in the movement direction, and making the housing unit and the contact portion come into contact with each other, such that contaminants removed from the housing unit by the contact portion are deposited into a storage unit.

* * * * *